US007858022B2

(12) United States Patent
Okada et al.

(10) Patent No.: US 7,858,022 B2
(45) Date of Patent: Dec. 28, 2010

(54) CRUCIBLE-TYPE CONTINUOUS MELTING FURNACE

(75) Inventors: Tamio Okada, Tokyo (JP); Tadao Sasaki, Tokyo (JP); Katsuyuki Shirakawa, Tokyo (JP); Ryouichi Kishida, Tokyo (JP); Shinnosuke Takeuchi, Tokyo (JP)

(73) Assignee: Nippon Crucible Co., Ltd., Tokyo (JP)

( * ) Notice: Subject to any disclaimer, the term of this patent is extended or adjusted under 35 U.S.C. 154(b) by 483 days.

(21) Appl. No.: 11/921,400

(22) PCT Filed: Jun. 8, 2006

(86) PCT No.: PCT/JP2006/311500

§ 371 (c)(1),
(2), (4) Date: Nov. 30, 2007

(87) PCT Pub. No.: WO2006/132309

PCT Pub. Date: Dec. 14, 2006

(65) Prior Publication Data

US 2009/0130619 A1 May 21, 2009

(30) Foreign Application Priority Data

Jun. 9, 2005 (JP) ..... 2005-169013

(51) Int. Cl.
*F27B 14/08* (2006.01)

(52) U.S. Cl. ..... 266/242; 266/901

(58) Field of Classification Search ..... 266/200, 266/242, 901

See application file for complete search history.

(56) References Cited

U.S. PATENT DOCUMENTS 4,033,562 A * 7/1977 Collin ..... 266/901
4,581,063 A * 4/1986 Oyabu et al. ..... 266/200
6,549,558 B1 4/2003 Okada et al.

FOREIGN PATENT DOCUMENTS

JP A-01-210794 8/1989
JP A-2000-130948 5/2000

OTHER PUBLICATIONS

International Search Report for corresponding international application No. PCT/JP2006/311500 dated Sep. 12, 2006.

* cited by examiner

*Primary Examiner*—Scott Kastler
(74) *Attorney, Agent, or Firm*—Posz Law Group, PLC

(57) ABSTRACT

A crucible-type continuous melting furnace includes a preheating tower for storing the material to be melted, and an exhaust port on the top thereof; a melting crucible furnace disposed below the preheating tower and having a melting crucible to which the material to be melted is supplied from the preheating tower; a heating burner for heating the melting crucible; and a preheating burner for preheating the material to be melted and disposed in a position that is higher than the heating burner; the melting crucible furnace having an introduction portion for introducing a combustion gas from the heating burner into the preheating tower; and the melting crucible having a molten metal outlet on the side wall for discharging the molten metal obtained by melting the material.

10 Claims, 8 Drawing Sheets

CRUCIBLE-TYPE CONTINUOUS MELTING FURNACE

TECHNICAL FIELD

The present invention relates to a crucible-type continuous melting furnace for melting aluminum, copper, zinc and like nonferrous metals.

BACKGROUND ART

As conventional nonferrous-metal furnaces using a melting crucible furnace, batch-type furnaces that have one melting crucible positioned in a cylindrical furnace, which is heated with a heating burner, have mainly been used. The applicant of the present invention proposes a "continuous type" melting and holding furnace (refer to Patent Document 1, for example).

As shown in FIG. 8, the continuous type melting and holding furnace disclosed in Patent Document 1 has a preheating tower 100 for preheating a material (a) to be melted, a melting crucible furnace 101 arranged immediately under the preheating tower 100, and a holding crucible furnace 102 disposed beside the melting crucible furnace 101. The preheating tower 100 can travel on rails 109 mounted on the melting crucible furnace 101. The melting crucible furnace 101 has a melting crucible 104 and a heating burner 105, and the holding crucible furnace 102 has a holding crucible 107 and a holding burner 105A.

Usually, when the continuous type melting and holding furnace 120 is operated, combustion gas is supplied from the heating burner 105 into a melting crucible chamber 103 to heat the melting crucible 104, and is introduced into the preheating tower 100 to preheat the material (a) in the form of a solid, and then is discharged from an exhaust port 100A. Molten metal (b) that results from heating the material (a) in the melting crucible 104 is supplied to the holding crucible 107 of the holding crucible furnace 102.

On the other hand, the combustion gas supplied from the holding burner 105A to the holding crucible chamber 106 heats the holding crucible 107 to maintain the temperature of the molten metal (b), and then is introduced into the melting crucible chamber 103 to join with the combustion gas from the heating burner 105. In such a way, the mixed combustion gas is used as the preheating source of the material (a).

[Patent Document 1] Japanese Unexamined Patent Publication No. 2000-130948

DISCLOSURE OF THE INVENTION

Problem to be Solved by the Invention

In order to increase the melted amount of the material (a) in the continuous type melting and holding furnace 120 as explained above, it is conceivable to increase the combustion amount of the heating burner 105 or increase the combustion amount of the holding burner 105A. However, enhancing the combustion amount of the heating burner 105 leads to local overheating of the melting crucible 104 or a larger temperature difference in the vertical direction of the melting crucible 104, resulting in cracks or damage in the melting crucible 104. On the other hand, the combustion amount of the holding burner 105A should be controlled depending on operating conditions, such as the type of the material (a), the amount of remaining molten metal, the casting temperature, casting frequency, etc.; therefore, the controllable range of the combustion amount of the holding burner 105A will naturally be limited. From these reasons, it is difficult to control the melted amount of the material (a) by controlling the heating burner 105 and the holding burner 105A in the conventional melting furnace.

An object of the present invention is to provide a crucible-type continuous melting furnace that can easily control the melted amount of a material.

Means for Solving the Problem

The object of the present invention can be achieved by a crucible-type continuous melting furnace that comprises: a preheating tower for storing a material to be melted and having an exhaust port on the top thereof; a melting crucible furnace disposed below the preheating tower and having a melting crucible to which the material to be melted is supplied from the preheating tower; a heating burner for heating the melting crucible; the melting crucible furnace having an introduction portion for introducing a combustion gas from the heating burner into the preheating tower; and the melting crucible having an outlet for discharging the molten metal material on the side wall, wherein the crucible-type continuous melting furnace further comprises a preheating burner disposed higher than the heating burner for preheating the material to be melted.

According to the crucible-type continuous melting furnace of the invention, it is preferable that the preheating burner be disposed so as to eject the combustion gas to a portion higher than the molten metal outlet of the melting crucible in the melting crucible furnace.

Alternatively, it is preferable that the preheating burner be mounted to the preheating tower.

It is also preferable that the crucible-type continuous melting furnace further include an iron pot disposed in the melting crucible, wherein the iron pot is provided with molten metal discharge holes for discharging the molten metal disposed so as to have a space between itself and the melting crucible.

It is also preferable that the iron pot be provided with a storage portion in the bottom thereof for storing a metal having a high specific gravity.

Moreover, it is preferable that the introduction portion lead the introduced combustion gas in a downward direction. For example, by providing a guiding member that projects toward the inside of the melting crucible on the bottom surface of the furnace lid of the melting crucible furnace, the introduction portion can be formed between the melting crucible and the guiding member.

Alternatively, by further providing a cylindrical crucible joint sandwiched between the bottom surface of the furnace lid of the melting crucible furnace and the top surface of the melting crucible, the introduction portion can also be formed from a plurality of holes provided in the crucible joint.

The introduction portion can also be formed from a plurality of holes provided in the higher portion than the molten metal outlet in the side wall of the melting crucible.

It is also preferable that the crucible-type continuous melting furnace further have a transferring member connected to the molten metal outlet, wherein the transferring member is formed of a material having high thermal conductivity.

Furthermore, in each of the above crucible-type continuous melting furnaces, it is preferable that the melting crucible be a graphite crucible.

Each of the above crucible-type continuous melting furnaces may further have a holding crucible furnace disposed in parallel to the melting crucible furnace. In this case, it is preferable that the holding crucible furnace be provided with a holding crucible for storing the molten metal discharged from the molten metal outlet and a holding burner for maintaining the temperature of the molten metal stored in the holding crucible, wherein the holding crucible furnace communicates with the melting crucible furnace via a communicating member, and a combustion gas from the holding burner is introduced into the melting crucible furnace.

EFFECT OF THE INVENTION

The crucible-type continuous melting furnace of the present invention can easily control the melted amount of a material.

Figure 1:
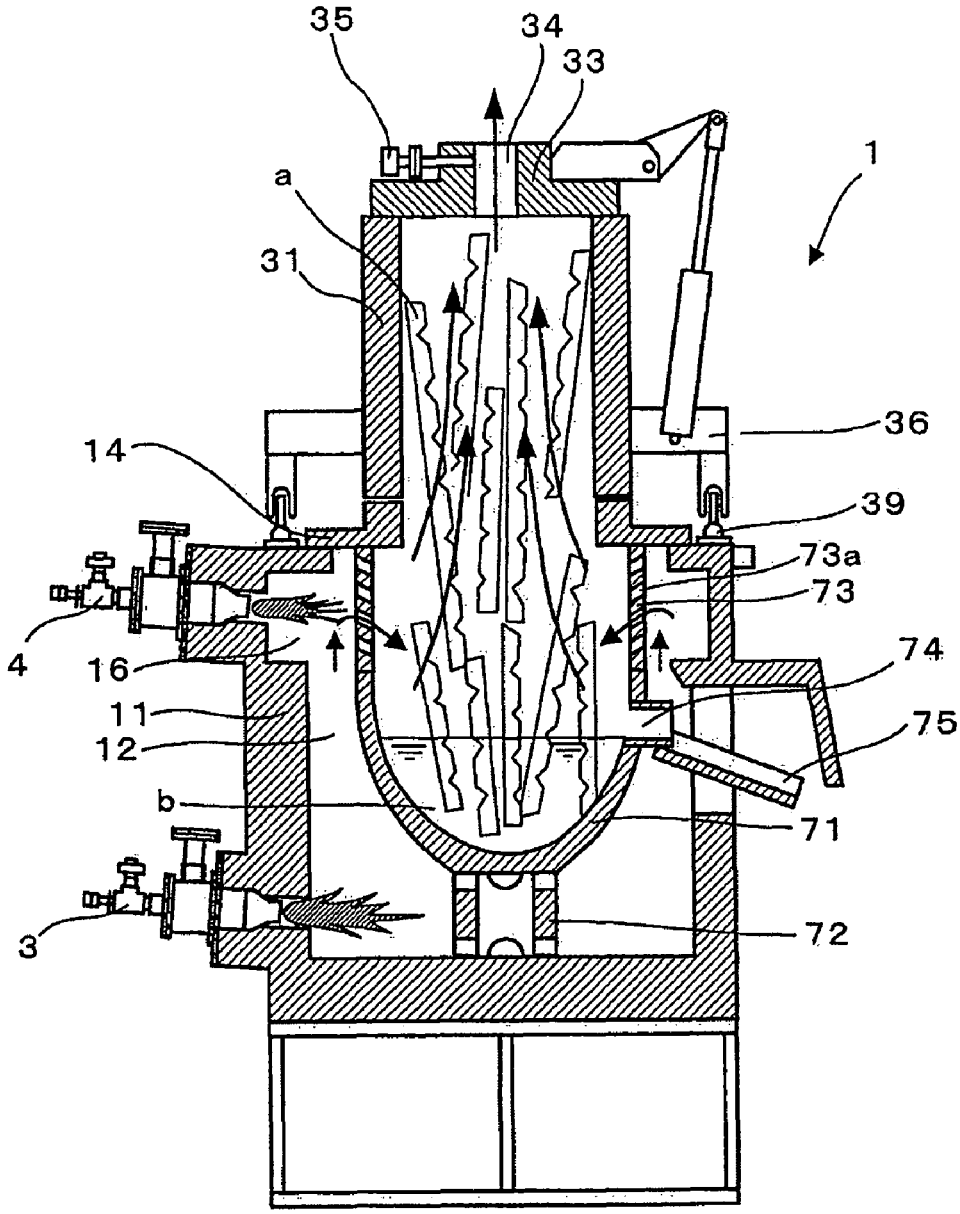
FIG. 1 shows a schematic structure of a crucible-type continuous melting furnace according to one embodiment of the present invention.

DESCRIPTION OF REFERENCE CHARACTERS a material to be melted
b molten metal
1 crucible-type continuous melting furnace
2 continuous melting and holding furnace
3 heating burner
4 preheating burner
5 holding burner
11 melting crucible furnace
12 melting crucible chamber
14 furnace lid
15 guiding member
31 preheating tower
33 opening and closing lid
34 exhaust port
51 holding crucible furnace
52 holding crucible chamber
70 cylindrical member
71 melting crucible
73 crucible joint
76 holding crucible
81 communicating member

BEST MODE FOR CARRYING OUT THE INVENTION

Embodiments of the present invention are explained below with reference to the attached drawings.

FIG. 1 shows the schematic structure of the crucible-type continuous melting furnace according to one embodiment of the present invention.

As shown in FIG. 1, this crucible-type continuous melting furnace 1 is provided with a preheating tower 31 for accommodating a metal to be melted (a) (hereunder, this may be simply referred to as material (a)), and a melting crucible furnace 11 disposed below the preheating tower 31.

The cylindrical preheating tower 31 is provided with an opening and closing lid 33 with an exhaust port 34 formed therein. The opening and closing lid 33 is provided with a thermocouple 35 that detects the temperature of the combustion gas passing through the exhaust port 34. The opening and closing lid 33 can be opened and closed by operating an automatic opening and closing mechanism (not shown) provided with a driving unit. The preheating tower 31 has a truck 36 in the lower portion thereof and is movable on a rail 39 located on the melting crucible furnace 11.

Examples of materials usable as the material (a) include aluminum, zinc, copper alloy, lead and like nonferrous metal ingots; recycled materials, metal chips, empty cans, door/window-sash materials and like scraps; scraps having their volume reduced by the application of pressure; nonferrous materials having iron, lead, rubber, plastic or a like component; etc.

The melting crucible furnace 11 is provided with a melting crucible chamber 12 and has a furnace lid 14 on the top thereof. The melting crucible chamber 12 is a cylindrical space formed of a lightweight insulating material, and communicates with the inside of the preheating tower 31 via the opening of the furnace lid 14. In the upper portion of the melting crucible chamber 12, a ring-shaped concave portion 16 is formed by notching the internal surface of the melting crucible furnace 11. The melting crucible furnace 11 is also provided with a melting crucible 71 mounted on a crucible base 72, and a heating burner 3 and preheating burner 4 mounted on the side wall thereof.

In the present embodiment, the melting crucible 71 is a graphite crucible, which has excellent durability, oxidation resistance, heat resistance, etc., and is provided with a molten metal outlet 74 for discharging a molten metal (b) obtained from the material (a). The diameter of the melting crucible 71 is larger than the inside diameters of the preheating tower 31 and the opening of the furnace lid 14. When the material (a) is zinc or a like material having a low melting point, the material for the melting crucible 71 may be iron, cast iron, etc., which have excellent thermal conductivity, heat resistance, strength, and cost-reduction properties. The molten metal (b) discharged from the molten metal outlet 74 can be continuously supplied to the outside via a transferring member 75 connected to the molten metal outlet 74. The transferring member 75 is formed of a material having excellent thermal conductivity, preferably iron, cast iron, stainless steel, or a like metal. The transferring member 75 may also be formed of the same refractory material as the graphite crucible; alumina; silicon carbide and like refractory ceramic materials; etc. A ceramic coating agent may be applied to the surface of the transferring member 75.

The heating burner 3 is disposed in the lower portion of the side wall of the melting crucible furnace 11 so that the combustion gas is circulated around the crucible base 72. In contrast, the preheating burner 4 is disposed in the upper portion of the side wall of the melting crucible furnace 11 so that the combustion gas is ejected to a portion higher than the molten metal outlet 74 and then circulates around the melting crucible 71. In the present embodiment, the preheating burner 4 is disposed in the concave portion 16 of the melting crucible chamber 12 in order to prevent the internal pressure of the melting crucible chamber 12 from being excessively increased due to the preheating burner 4 coming unduly close to the external surface of the melting crucible 71.

A cylindrical crucible joint 73 formed of a refractory material lies between the bottom surface of the furnace lid 14 and the top of the melting crucible 71 via a cushioning material and a heat-resistant adhesive (both not shown) so that the space between the bottom surface of the furnace lid 14 and the top of the melting crucible 71 is sealed. A plurality of ventholes 73*a* for exchanging a combustion gas are formed in the side wall of the crucible joint 73.

Figure 2:
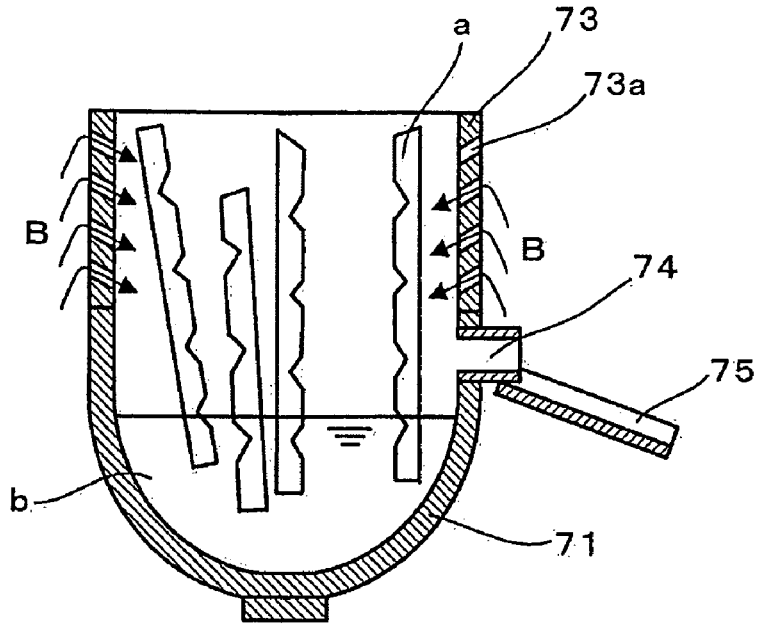
FIG. 2 is a side cross-sectional view of a crucible joint.
Figure 3:
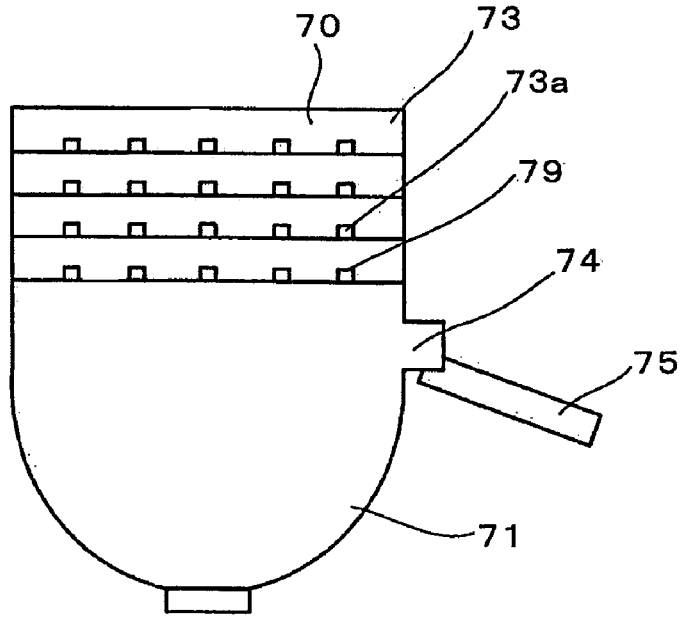
FIG. 3 is a side view of a crucible joint according to another embodiment.

As shown in FIG. 2, the ventholes 73*a* are formed as a plurality of inclination holes so that the combustion gas introduced into the melting crucible 71 is guided downwardly. It is preferable that the ventholes 73*a* have small diameters so that the material (a) is not partially heated and oxidized, and small particles of the material (a) are not dropped from the melting crucible 71. It is also preferable that the ventholes 73*a* be arranged so as to be distributed in the axial direction of the crucible joint 73 so that the temperature difference in the vertical direction of the material (a) can be canceled. It is preferable that the ventholes 73*a* be formed so as to be distributed in the circumferential direction of the crucible joint 73 so that the combustion gas is thoroughly introduced into the melting crucible 71. The ventholes 73*a* are not limited to inclination holes and may have horizontal holes, or a combination of horizontal holes and inclination holes. The diameter and number of the holes can be selected depending on the application thereof. For example, inclination holes may be formed in the upper portion of the crucible joint 73 and horizontal holes may be formed in the lower portion of the crucible joint 73. This allows effective preheating of the material (a) and prevents oxidation of the molten metal (b). The shape of the ventholes 73*a* is not limited to circular and may be square. There are no limitations to the method for forming the ventholes 73*a* and, for example, a crucible joint 73 having ventholes 73*a* may be obtained by forming a plurality of square grooves 79 on one end of the cylindrical member 70 and stacking the cylindrical members 70 as shown in FIG. 3.

The material for the crucible joint 73 may be the same as that of the graphite crucible; those having excellent oxidation resistance and/or abrasion resistance, such as silicon carbide (SiC), silicon nitride ($Si_3N_4$), sialon ($Si_3N_4$—$Al_2O_3$ solid solution); a backed or sintered object of molten silica; etc. From an economical standpoint, an alumina-silica ($Al_2O_3$—$SiO_2$)-based refractory material is preferable, but the material for the crucible joint 73 may be selected depending on the type of material (a), operating conditions, etc.

Having the above-described structure, the crucible-type continuous melting furnace 1 of the present invention operates as described below.

A material (a) is melted using the crucible-type continuous melting furnace 1 of the present invention in the manner described below. First, the preheating tower 31 is transferred in such a manner that the upper portion of the melting crucible furnace 11 is opened. Thereafter, the material (a) is placed into the melting crucible 71, and then the preheating tower 31 is returned and mounted to the top of the melting crucible furnace 11. Subsequently, an opening and closing lid 33 is opened to supply a desired amount of the material (a) to the preheating tower 31, and then melting of the material (a) is started by operating the heating burner 3.

The combustion gas ejected by operating the heating burner 3 heats the lower portion of the melting crucible 71 so as to obtain a molten metal (b) by melting the material (a) accommodated therein. Because the melting crucible 71 is a graphite crucible, an iron container or the like which has excellent thermal conductivity, the material (a) can be easily melted. The ejected combustion gas moves upward while circulating in the melting crucible chamber 12, passes through the ventholes 73*a*, and is discharged outside from the exhaust port 34 via the inside of the melting crucible 71 and the preheating tower 31. During this process, in order to make the material (a) melt easily, the combustion gas preheats the material (a) before the material (a) is dipped into the molten metal (b). The combustion amount of the heating burner 3 can be selected depending on the amount of the molten material (a). For example, in order to increase the amount of the melted material (a), the combustion amount of the heating burner 3 should be increased. At this time, if the combustion amount of the heating burner 3 rapidly increases, a temperature difference occurs in the vertical direction of the melting crucible 71, damaging the melting crucible 71. In order to prevent the melting crucible 71 from being damaged, the combustion amount of the preheating burner 4 should also be controlled.

The combustion gas ejected by operating the preheating burner 4 heats the upper portion of the melting crucible 71 and cancels the temperature difference of the melting crucible 71 in the vertical direction. The combustion gas ejected from the preheating burner 4 joins with the combustion gas ejected from the heating burner 3 and preheats the material (a). It is preferable that the combustion amount of the preheating burner 4 be controlled within the range in which the material (a) does not melt above the surface of the molten metal (b) and oxidation of the material (a) does not rapidly progress.

When the combustion gases ejected from the heating burner 3 and the preheating burner 4 passes through the ventholes 73*a*, the combustion gas is guided in the downward direction in the melting crucible 71 along the slant, so that the material (a) in the vicinity of the surface of the molten metal can be efficiently heated. Furthermore, because a plurality of ventholes 73*a* are formed both in the circumferential and vertical directions to facilitate a smooth flow of the combustion gas, the material (a) stored in the preheating tower 31 and the melting crucible 71 can be extensively and uniformly preheated in the portion above the surface of the molten metal, and an excessive increase in the internal pressure of the melting crucible chamber 12 can be prevented.

In contrast, the molten metal (b) is continuously discharged from the molten metal outlet 74 as the material (a) in the melting crucible 71 melts, and is then supplied to a holding crucible furnace, a brick holding furnace, or a conveyance ladle (not shown) through transferring member 75. At this time, the temperature of the molten metal (b) passing through the transferring member 75 is maintained by the transferring member 75. As described above, because the molten metal (b) is continuously discharged, the height of the surface of the molten metal in the melting crucible 71 can be maintained at a certain level. Most of the combustion gas energy ejected from the heating burner 3 is consumed to melt the material (a) and only a small amount thereof is used to increase the temperature of the molten metal (b), and therefore the temperature of the molten metal (b) can be maintained at a level only slightly higher than the melting point of the material (a) and the generation of oxide can be prevented. Furthermore, because the transferring member 75 is formed of a material having excellent thermal conductivity, the temperature of the molten metal (b) on the transferring member 75 can be readily maintained.

As the material (a) melts, the material (a) in the preheating tower 31 gradually moves downward, and eventually is dipped in the molten metal (b) in the melting crucible 71. When the material (a) in the preheating tower 31 gradually decreases, the combustion gas energy is not consumed by preheating, and therefore the temperature of the combustion gas in the preheating tower 31 increases. When the temperature of the combustion gas exceeds a predetermined point (for example, 500° C.), the thermocouple 35 detects such excess and sends a signal to supply the material (a). In accordance with this signal, an opening and closing mechanism (not shown) then opens an opening and closing lid 33 and turns off the heating burner 3 and preheating burner 4. Subsequently, the material (a) is automatically supplied from the opening of the preheating tower 31. When the supply is completed, the opening and closing lid 33 is closed, and then the heating burner 3 and the preheating burner 4 are re-operated.

In a crucible-type continuous melting furnace 1 having the above structure, by controlling the combustion amount of the heating burner 3 and the preheating burner 4, the melted amount of the material (a) can be easily controlled. This structure also cancels the temperature difference in the vertical direction in the melting crucible 71, and therefore can reliably prevent damage to the melting crucible 71. Furthermore, by controlling the two burners, a large amount of material can be melted without supplying a combustion gas from a holding burner as in known techniques described above.

Figure 4:
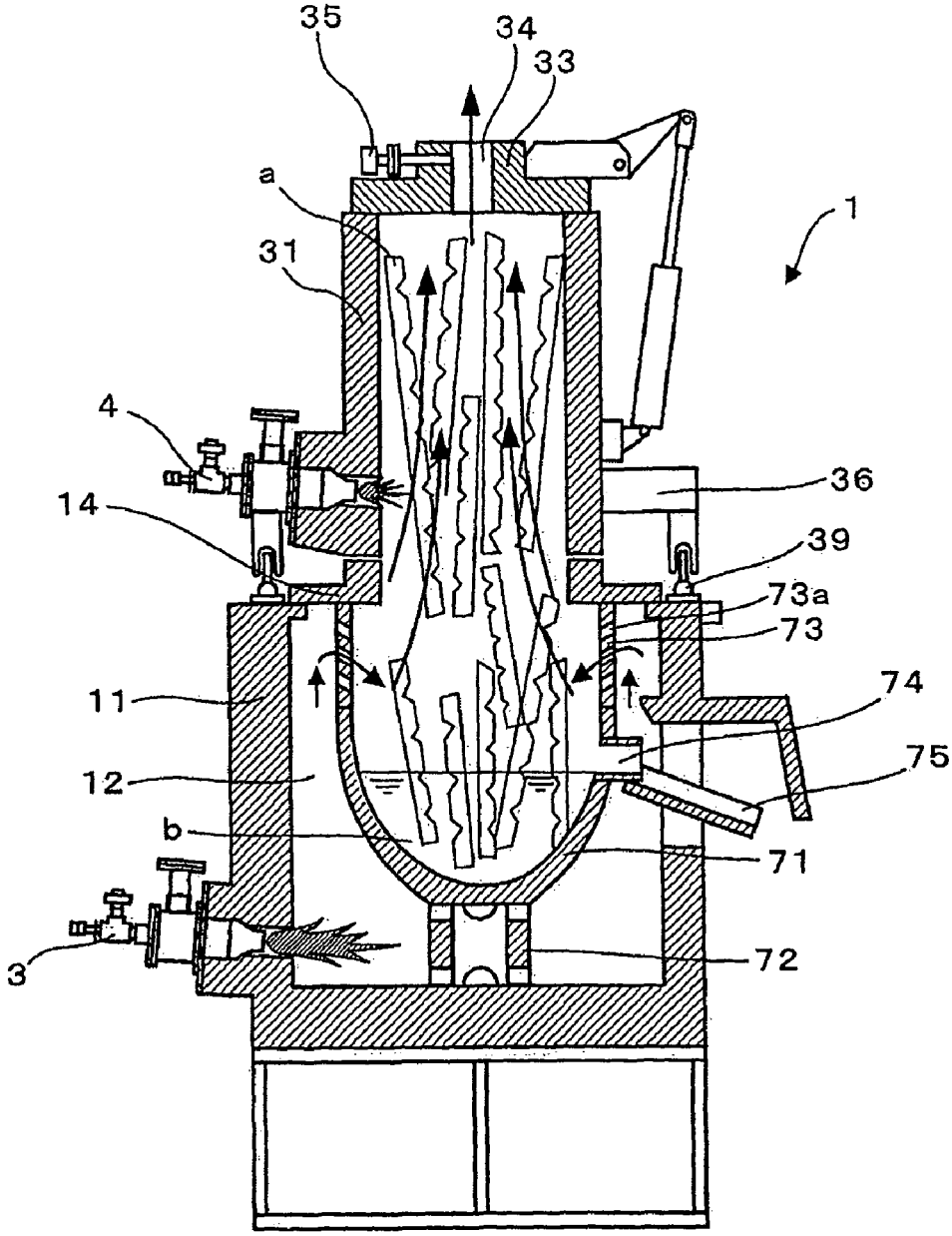
FIG. 4 shows a schematic structure of a crucible-type continuous melting furnace according to another embodiment.

One embodiment of the present invention is explained above, but the embodiments of the present invention are not limited to this. For example, in the present embodiment, the preheating burner 4 is attached to the melting crucible furnace 11; however, as long as the supplied material (a) can be efficiently preheated, there are no limitations to the location of the preheating burner 4. For example, as shown in FIG. 4, the preheating burner 4 may be attached to the preheating tower 31. In this structure, because the combustion gas is directly ejected toward the material (a), the material (a) can be efficiently preheated and the amount that is melted can be readily controlled. In this case, in order to efficiently use the combustion gas that gradually moves upward in the preheating tower 31, it is preferable that the preheating burner 4 be located in a lower portion of the preheating tower 31.

Figure 10:
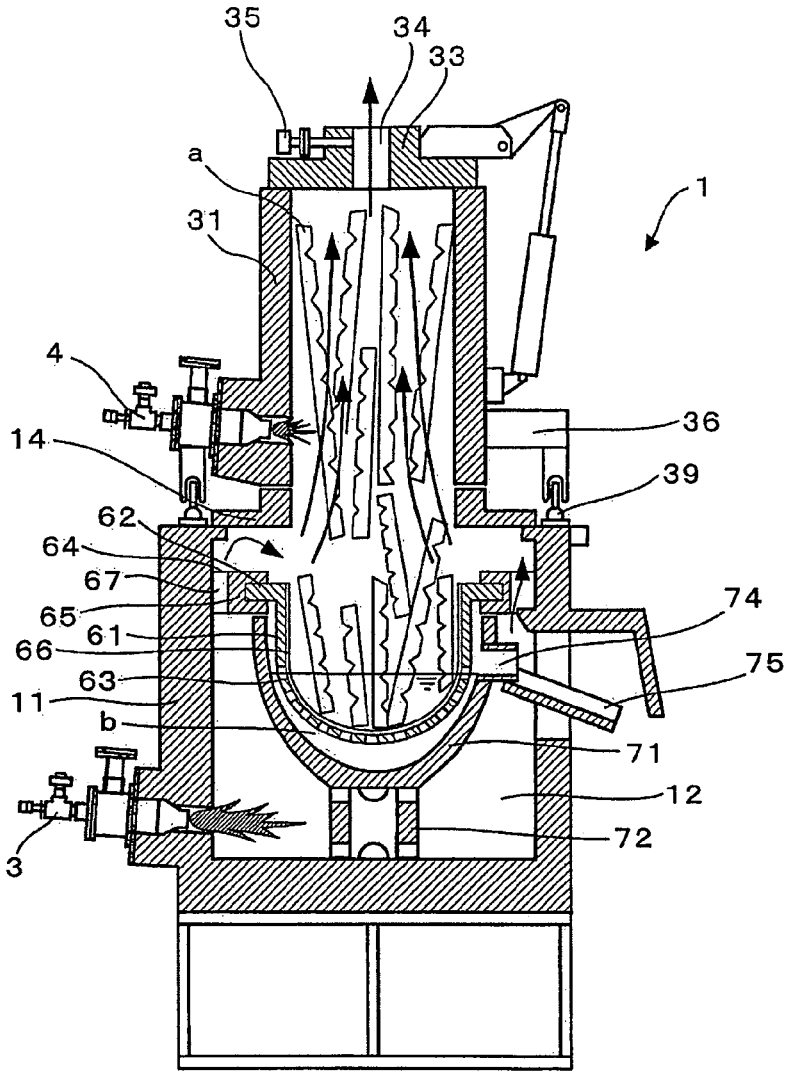
FIG. 10 shows a schematic structure of a crucible-type continuous melting furnace according to still another embodiment.

When the preheating burner 4 is attached to the preheating tower 31, the crucible-type continuous melting furnace 1 may be provided with an iron pot 61 in the melting crucible 71 as shown in FIG. 10. The iron pot 61 is disposed so as to have a space between itself and the melting crucible 71, and has a plurality of molten metal discharge holes 63 for discharging the molten metal, and a flange 62 outwardly extruding from the periphery on the top portion thereof. It is preferable that the space between the melting crucible 71 and the iron pot 61 exist along the entire inner surface of the melting crucible 71. An iron mesh 66 is provided inside the iron pot 61 so as to fit the inner surface thereof. A holding member 64, which inwardly extends and holds the iron pot 61, is provided on the inner surface of the side wall of the melting crucible furnace 11. The holding member 64 is provided with a gas transit hole 67 through which a combustion gas passes. The holding member 64 is also provided with a connecting member 65 having a U-shape in cross section. The iron pot 61 can be held by the structure wherein a flange 62 engages with this connecting member 65. In this construction, the material (a) supplied in the preheating tower 31 drops into the iron pot 61 and is then melted in the iron pot 61. When melted, the material (a) becomes the molten metal (b), flows out of the iron pot 61 through the molten metal discharge hole 63, and is then discharged from a molten metal outlet 74. At this time, because the iron pot 61 is disposed in the melting crucible 71 so as to have a space between itself and the internal surface of the melting crucible 71, the supplied material (a) does not drop directly into the melting crucible 71 but drops into the iron pot 61. This reduces the dropping impact conveyed to the melting crucible 71, preventing damage to the melting crucible 71. In particular, when the supply amount of the material (a) is increased or the material (a) is large, the dropping impact tends to be great, and therefore this structure is very effective. Because an iron mesh 66 is provided inside the iron pot 61, non-melted metal material (a) can be readily collected from the molten metal (b) using the iron mesh 66.

Figure 11:
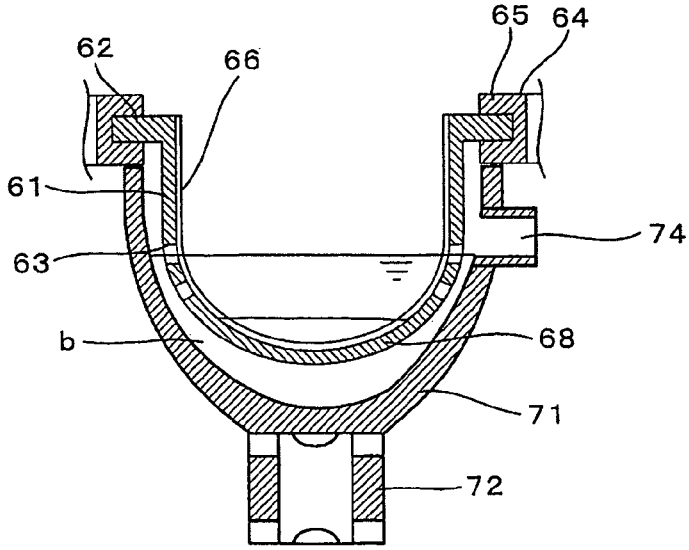
FIG. 11 is a longitudinal sectional view of a principal part of a crucible-type continuous melting furnace according to still another embodiment.

As shown in FIG. 11, the molten metal discharge hole 63 may be disposed in the vicinity of the liquid surface of the molten metal (b) instead of in the vicinity of the bottom portion of the iron pot 61, so that a storage portion 68 is formed on the lowermost portion of the iron pot 61. By employing such a construction, metal components contained in the molten metal (b) can be easily separated using the difference in specific gravity, since metals having a high specific gravity are stored in the storage portion 68. For example, when lead and aluminum are contained in the molten metal (b), such as when an aluminum wheel to which a lead wheel balancer is attached is melted as the material (a), because lead has a higher specific gravity, it precipitates to the storage portion 68. Therefore, the lead will not be discharged from the molten metal discharge hole 63, which is formed in the vicinity of the liquid surface of the molten metal (b). However, because aluminum has a lower specific gravity than lead, it melts in a portion that is higher than where lead melts and is discharged from the molten metal discharge hole 63. Therefore, lead and aluminum can be separated by storing the lead in the storage portion 68 and discharging the aluminum outside the iron pot 61. Likewise, iron, stainless steel and zinc can be separated from each other by utilizing the differences in specific gravity.

Figure 5:
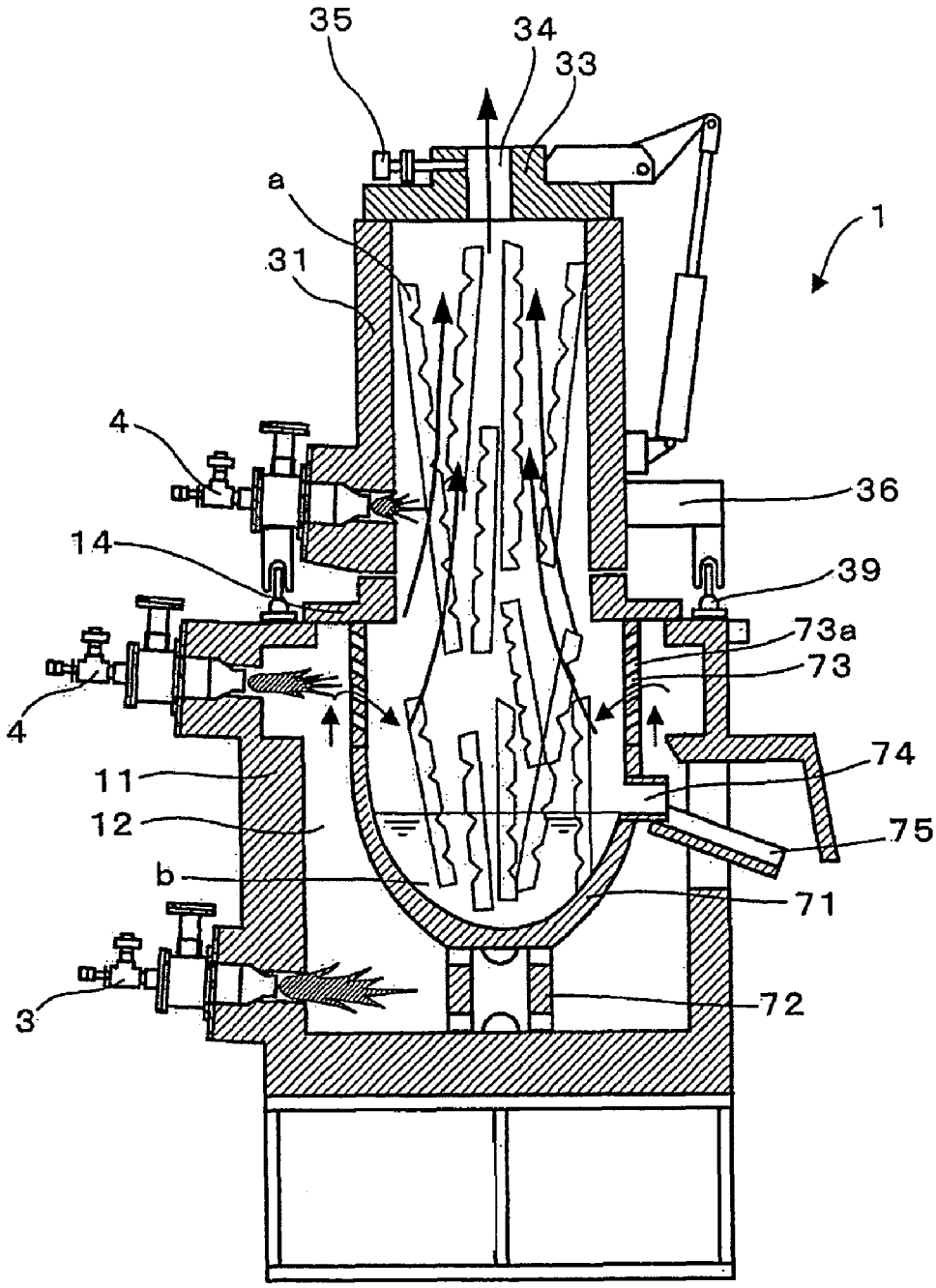
FIG. 5 shows a schematic structure of a crucible-type continuous melting furnace according to still another embodiment.

The crucible-type continuous melting furnace 1 may have a construction wherein each of two preheating burners 4 is attached to the melting crucible furnace 11 and preheating tower 31 as shown in FIG. 5. In this construction, by utilizing combustion gases from the two preheating burners 4, the preheating temperature and/or preheating range of the material (a) can be increased, so the melted amount can be readily controlled by controlling the combustion amounts of the two burners independently.

Figure 6:
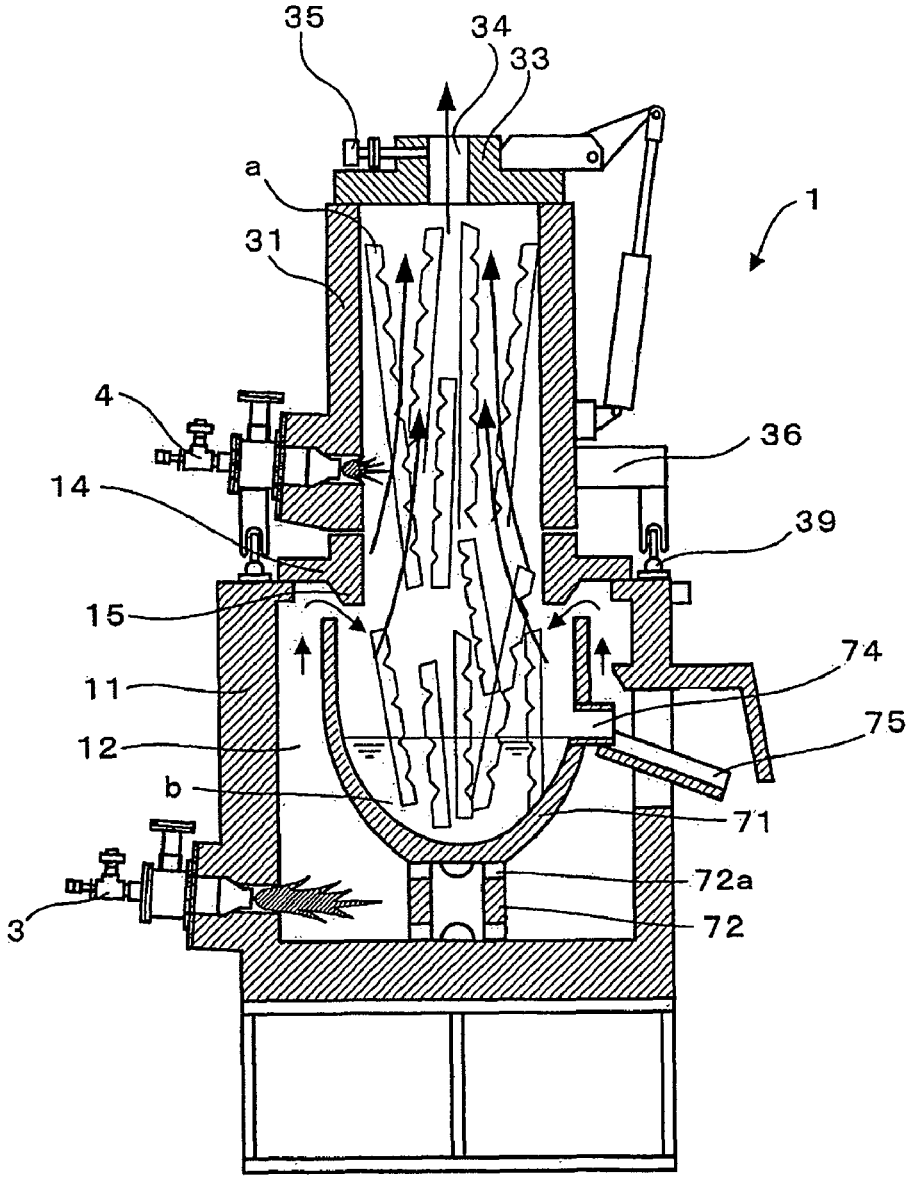
FIG. 6 shows a schematic structure of a crucible-type continuous melting furnace according to still another embodiment.

In the present embodiment, the crucible joint 73 is located between the lower surface of the furnace lid 14 and the melting crucible 71; however, the location of the crucible joint 73 is not limited to this as long as the combustion gas smoothly flows in the downward direction in the melting crucible 71. For example, as shown in FIG. 6, the construction may be such that a guiding member 15 projecting toward the inner side of the melting crucible 71 is provided on the lower surface of the furnace lid 14, and the combustion gas passes through the introduction portion formed between the guiding member 15 and the melting crucible 71. In this construction, because the combustion gas flows downwardly in the melting crucible 71 along the guiding member 15, the material (a) in the vicinity of the surface of the molten metal can be efficiently preheated.

It is also possible to employ a construction wherein the ventholes 73*a*, which serve as the introduction portion of the combustion gas, are formed in the side wall of the melting crucible 71, and the top end of the melting crucible 71 is brought into contact with the lower surface of the furnace lid 14. In this construction, because the ventholes 73*a* and the melting crucible 71 are integrally formed, the combustion gas reliably passes through the ventholes 73*a*. In this case, in order to prevent the molten metal (b) from falling outside the melting crucible 71, it is preferable that the ventholes 73*a* be formed at a location higher than the molten metal outlet 74 that is formed in the side wall of the melting crucible 71.

When the melting crucible 71 is formed of iron, alumite coating may be applied to the surface thereof.

The height of the molten metal outlet 74 in the melting crucible 71 can be selected as desired.

Figure 7:
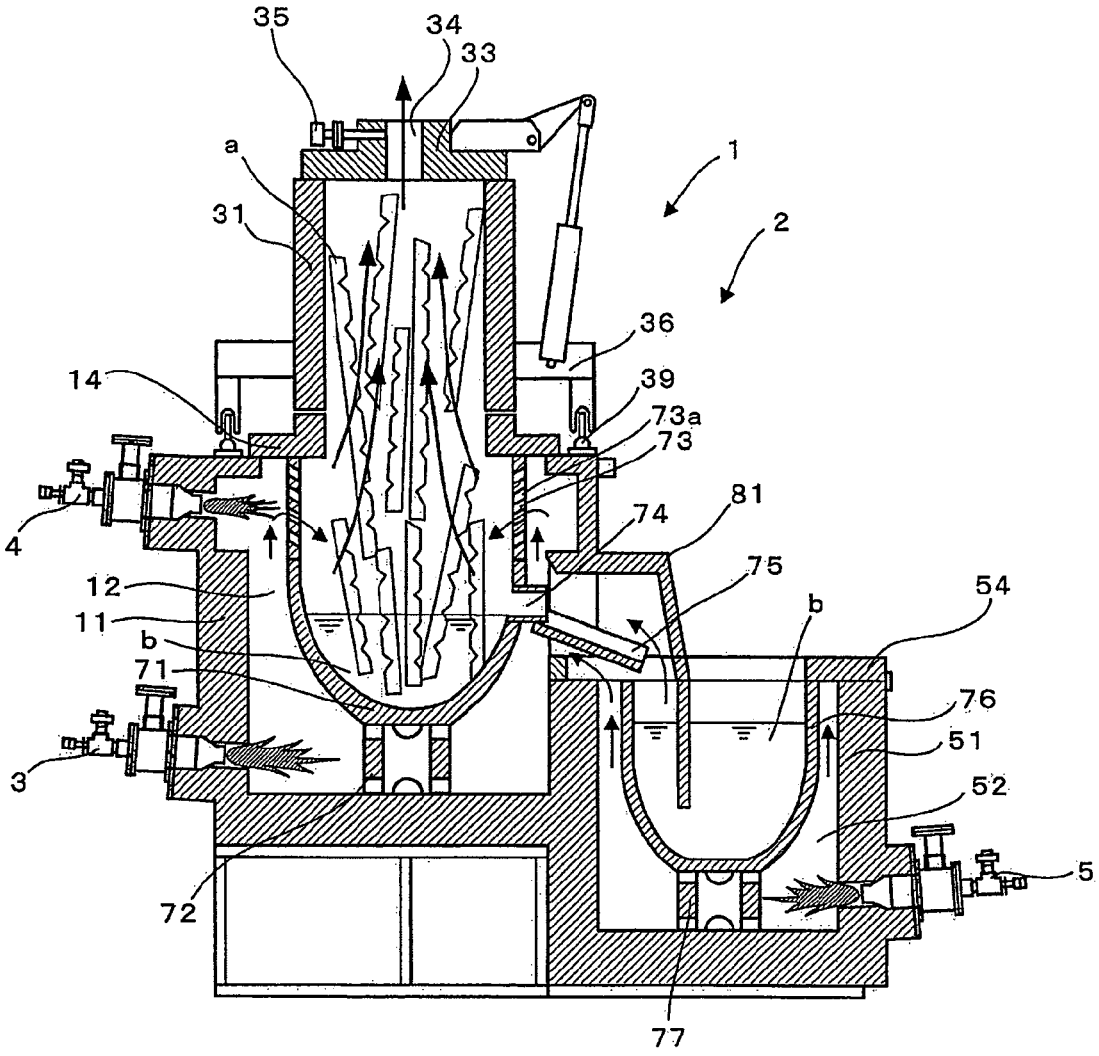
FIG. 7 shows a schematic structure of a continuous melting and holding furnace according to another embodiment of the present invention.

The present embodiment is just one example of a continuous melting furnace which can continuously supply the molten metal (b) obtained by melting the material (a); however, the crucible-type continuous melting furnace 1 of the present invention may also be applicable to a continuous melting and holding furnace 2 as shown in FIG. 7. The continuous melting and holding furnace 2 is provided with the crucible-type continuous melting furnace 1, a holding crucible furnace 51 and a communicating member 81.

The holding crucible furnace 51 is disposed in parallel to the melting crucible furnace 11 of the crucible-type continuous melting furnace 1, and provided with a holding crucible chamber 52 and a pressing lid 54 formed on top thereof. The holding crucible furnace 51 has a holding crucible 76 mounted on a crucible base 77 and a holding burner 5 attached to the side wall thereof. The holding crucible 76 is, for example, a graphite crucible, and may be formed of iron, cast iron or the like depending on its purpose.

The holding crucible chamber 52 contains a cylindrical space formed by a lightweight insulating material, and communicates with the melting crucible chamber 12 via the inside of the communicating member 81.

The communicating member 81 is formed between the melting crucible furnace 11 and the holding crucible furnace 51 in such a manner as to cover the transferring member 75.

Having the above-described construction, the continuous melting and holding furnace 2 operates as described below. The explanation of the operation of the crucible-type continuous melting furnace 1 is omitted here as it is the same as that described above.

The molten metal (b) that is melted in the crucible-type continuous melting furnace 1 is discharged from the outlet 74 of the melting crucible 71 and supplied to the holding crucible 76 through the transferring member 75.

The combustion gas ejected from the holding burner 5 heats the holding crucible 76 while moving upward and circulating in the holding crucible chamber 52. The combustion gas is then introduced into the melting crucible chamber 12 after passing through the inside of the communicating member 81 while maintaining the temperature of the molten metal (b) contained in the holding crucible chamber 52. The combustion gas introduced into the melting crucible 71 joins with the combustion gases from the heating burner 3 and preheating burner 4. Subsequently, the combustion gas is introduced into the preheating tower 31 after moving upward in the melting crucible 71 and then discharged to the outside from the exhaust port 34. During this process, the combustion gas preheats the material (a). The combustion amount of the holding burner 5 is selected depending on the type of the material (a) and the amount and temperature of the remaining molten metal (b).

In this construction, since the combustion gas from the holding burner 5 is added, the melting amount can be readily controlled by controlling each burner independently.

In the present embodiment, the holding crucible furnace 51 is used as a stationary type but may also be used as a mobile type. By employing such a construction, the size of the holding crucible furnace 51 can be selected depending on the amounts of the material melted and held.

EXAMPLE

The present invention is explained in detail in reference with an Example and Comparative Examples. However, the present invention is not limited to the Example.

Figure 8:
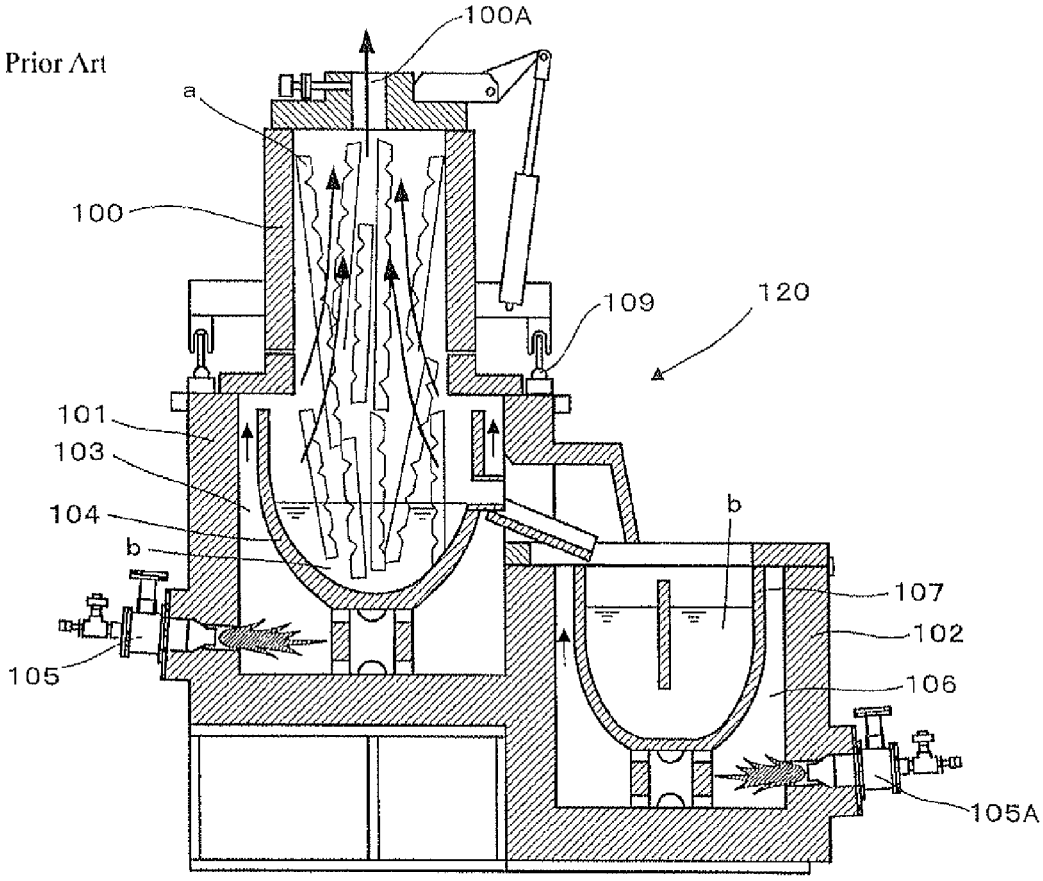
Fig. 8 Prior Art
FIG. 8 is a front cross-sectional view of a known continuous type melting and holding furnace.
Figure 9:
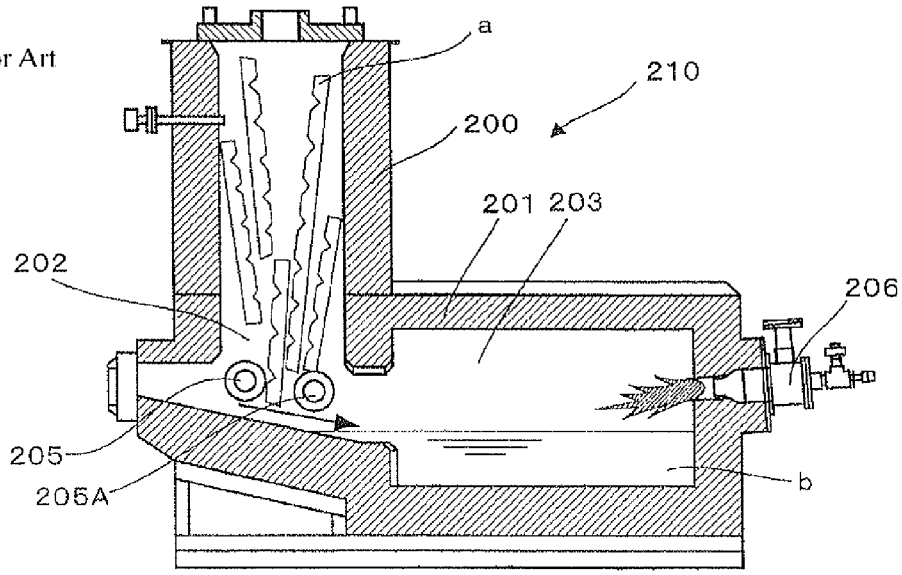
Fig. 9 Prior Art
FIG. 9 is a front cross-sectional view of a known direct-heating centralized melting furnace.

Die casting alloy ADC12 was melted in a continuous melting and holding furnace 2 (Example) shown in FIG. 7, a known continuous type melting and holding furnace 120 (Comparative Examples 1 and 2) shown in FIG. 8, and a direct-heating centralized melting furnace 210 (Comparative Example 3) shown in FIG. 9.

The sizes of the melting furnaces of the Example and Comparative Examples 1 and 2 were substantially the same. Specifically, the dimensions of the preheating towers 31 and 100 were 550 mm (inside diameter)×1000 mm (height), those of the melting crucibles 71 and 104 were 718 mm (diameter of the opening)×520 mm (height), and those of the holding crucibles 76 and 107 were 855 mm (diameter of the opening)×845 mm (height).

A crucible joint 73 having the dimensions of 718 mm (inside diameter)×260 mm (height) was provided on top of the melting crucible 71. The ventholes 73*a* formed in the crucible joint 73 were holes inclined 30° relative to the surface of the molten metal and having a diameter of 30 mm. Sixteen or eight holes were formed in a row in the circumferential direction of the crucible joint 73, and 5 rows each (16 or 8 holes) were formed alternately in the height direction, making total of 120 holes.

The direct-heating centralized melting furnace 210 of Comparative Example 3 was provided with a preheating tower 200 and a melting furnace 201 disposed below the preheating tower 200, wherein the melting furnace 201 was provided with a melting chamber 202, a storage chamber 203, two heating burners 205 and 205A, and a temperature-raising burner 206.

When the direct-heating centralized melting furnace 210 was operated, the material (a) placed in the preheating tower 200 was melted in the melting chamber 202 disposed in the lower portion thereof by the combustion gases ejected from the two heating burners 205 and 205A, and then supplied into the storage chamber 203. The molten metal (b) supplied into the storage chamber 203 was heated to a predetermined temperature by the combustion gas from the temperature-raising burner 206, and then extracted by a ladle, etc.

A comparison of the relationships between the combustion amounts of the burners and the melted amount of the material was conducted between the Example and the Comparative Examples. Table 1 shows the combustion amount of each burner and the melted amount of the material in each furnace of the Example and the Comparative Examples.

The material was melted in each furnace of the Example and Comparative Example 1 with the combustion amount of each burner set as shown in Table 1. As shown in Table 1, the melted amounts of the material in the Example and Comparative Example 1 were 1 t/h and 300 kg/h respectively. It is clear that the melted amount in the Example was larger than that of the Comparative Example 1.

In the furnace of Comparative Example 2, the total combustion amount of the burner was set at the same level as that in the Example as shown in Table 1 so as to obtain the same melted amount as in the Example, and then melting was conducted. As a result, the melting crucible 104 was damaged during melting, and therefore the same melted amount as in the Example was not obtained in Comparative Example 2.

In the furnace of Comparative Example 3, melting was conducted with the melting amount set at 1 t/h, which is the same as that in the Example. At this time, the temperature of the molten metal (b) stored in the holding crucible 76 and storage chamber 203 was made to be the same and maintained at 700° C. As a result, as is clear from Table 1, the total combustion amount of Comparative Example 3 was larger than that of the Example.

TABLE 1

| | Combustion Amount ($\times 10^4$ Kcal/h) | | | | |
|---|---|---|---|---|---|
| | Heating Burner | Preheating Burner | Holding Burner or Temperature-Raising burner | Total | Melted Amount (t/h) |
| Example | 20 | 20 | 15 | 55 | 1 |
| Comparative Example 1 | 15 | — | 15 | 30 | 0.3 |
| Comparative Example 2 | 40 | — | 15 | 55 | — |
| Comparative Example 3 | 25 + 25 = 50 | — | 24 | 74 | 1 |

Regarding the space occupied by the melting furnace, a comparison was made between the Example and Comparative Example 3. Table 2 shows the height (the height from the floor level to the topmost part of the melting furnace), the area occupied (the footprint of the melting furnace), the volume occupied (the height of the melting furnace×the footprint), and the combustion amount of the Example when the corresponding values for Comparative Example 3 are set to 100. As is clear from Table 2, the Example reduced the space and energy necessary compared to Comparative Example 3 for which the melted amount was the same.

TABLE 2

| | Height | Area Occupied | Volume Occupied | Combustion Amount |
|---|---|---|---|---|
| Example | 84 | 23 | 13 | 74 |
| Comparative Example 3 | 100 | 100 | 100 | 100 |

The invention claimed is:

1. A crucible-type continuous melting furnace comprising:

a preheating tower for storing a material to be melted and having an exhaust port on the top thereof;

a melting crucible furnace disposed below the preheating tower and having a melting crucible to which the material to be melted is supplied from the preheating tower;

a heating burner for heating the melting crucible;

wherein the melting crucible furnace includes an introduction portion for introducing a combustion gas from the heating burner into the preheating tower; and wherein the melting crucible has a side wall, and an outlet for discharging the molten metal material is formed in the side wall, wherein the crucible-type continuous melting furnace further comprises a preheating burner disposed higher than the heating burner for preheating the material to be melted, and wherein the preheating burner is located to eject the combustion gas to a portion of the melting crucible furnace that is higher than the molten metal outlet of the melting crucible.

2. A crucible-type continuous melting furnace comprising:

a preheating tower for storing a material to be melted and having an exhaust port on the top thereof;

a melting crucible furnace disposed below the preheating tower and having a melting crucible to which the material to be melted is supplied from the preheating tower;

a heating burner for heating the melting crucible;

wherein the melting crucible furnace includes an introduction portion for introducing a combustion gas from the heating burner into the preheating tower;

wherein the melting crucible has a side wall, and an outlet for discharging the molten metal material is formed in the side wall, wherein the crucible-type continuous melting furnace further comprises a preheating burner disposed higher than the heating burner for preheating the material to be melted, wherein the preheating burner is mounted to the preheating tower, wherein the crucible-type continuous melting furnace further comprises an iron pot located in the melting crucible, and wherein the iron pot is provided with a molten metal discharge hole for discharging the molten metal, and the iron pot is located so that a space is formed between the iron pot and the melting crucible.

3. A crucible-type continuous melting furnace according to claim 2, wherein the iron pot is provided with a storage portion in the bottom thereof for storing a metal having a high specific gravity.

4. A crucible-type continuous melting furnace according to claim 1, wherein the introduction portion leads the introduced combustion gas in a downward direction.

5. A crucible-type continuous melting furnace according to claim 1, wherein a guiding member projecting toward the inside of the melting crucible is provided on the bottom surface of the furnace lid of the melting crucible furnace, and the introduction portion is formed between the melting crucible and the guiding member.

6. A crucible-type continuous melting furnace according to claim 4, which further comprises a cylindrical crucible joint sandwiched between the bottom surface of the furnace lid of the melting crucible furnace and the top of the melting crucible, wherein the introduction portion is formed form a plurality of holes provided in the crucible joint.

7. A crucible-type continuous melting furnace according to claim 4, wherein the introduction portion is formed from a plurality of holes provided in the higher portion than the molten metal outlet in the side wall of the melting crucible.

8. A crucible-type continuous melting furnace according to claim 1, which further comprises a transferring member connected to the molten metal outlet, wherein the transferring member is formed of a material having high thermal conductivity.

9. A crucible-type continuous melting furnace according to claim 1, wherein the melting crucible is a graphite crucible.

10. A crucible-type continuous melting furnace according to claim 1, wherein the crucible-type continuous melting furnace further comprises a holding crucible furnace disposed in parallel to the melting crucible furnace;

the holding crucible furnace being provided with a holding crucible for storing the molten metal discharged from the molten metal outlet and a holding burner for maintaining the temperature of the molten metal stored in the holding crucible; and the holding crucible furnace communicates with the melting crucible furnace via a communicating member, and a combustion gas from the holding burner is introduced into the melting crucible furnace.

* * * * *